US005987794A

United States Patent [19]

Lavi et al.

[11] Patent Number: 5,987,794

[45] Date of Patent: Nov. 23, 1999

[54] SIGN WITH REPLACEMENT INSERT

[75] Inventors: Gavriel Lavi; Susan Lavi, both of Valencia, Calif.

[73] Assignee: Lavi Industries, Valencia, Calif.

[21] Appl. No.: 08/821,792

[22] Filed: Mar. 21, 1997

Related U.S. Application Data

[60] Provisional application No. 60/039,602, Feb. 28, 1997.

[51] Int. Cl.[6] ..... G09F 7/02

[52] U.S. Cl. ..... 40/611; 40/490; 40/606

[58] Field of Search ..... 40/611, 606, 490, 40/575, 649, 766

[56] References Cited

U.S. PATENT DOCUMENTS

| | | | |
|---|---|---|---|
| 1,571,098 | 1/1926 | Rimke . | |
| 1,674,264 | 6/1928 | Prather . | |
| 2,844,897 | 7/1958 | Vance . | |
| 3,987,567 | 10/1976 | Fritts | 40/611 X |
| 4,007,552 | 2/1977 | Brooks . | |
| 4,081,119 | 3/1978 | Messmore . | |
| 4,144,664 | 3/1979 | DeKorte . | |
| 4,145,828 | 3/1979 | Hillstrom . | |
| 4,282,667 | 8/1981 | Glade | 40/611 X |
| 4,299,043 | 11/1981 | Lathrop et al. | 40/611 X |
| 4,322,905 | 4/1982 | Kruse . | |
| 4,512,095 | 4/1985 | Seely . | |
| 5,088,221 | 2/1992 | Bussiere et al. | 40/611 X |
| 5,377,434 | 1/1995 | Wilson | 40/611 |
| 5,419,134 | 5/1995 | Gibson | 40/606 |
| 5,442,871 | 8/1995 | Sarkisian et al. | 40/611 X |

FOREIGN PATENT DOCUMENTS

| | | |
|---|---|---|
| 2416334 | 8/1979 | France . |
| 2625019 | 6/1989 | France . |
| 9429836 | 12/1994 | WIPO . |

*Primary Examiner*—Blair M. Johnson
*Attorney, Agent, or Firm*—Pillsbury Madison & Sutro LLP

[57] ABSTRACT

A frame structure that displays media includes a support member, a frame housing and at least one interchangeable cartridge insert. The frame housing is supported by the support member and has at least one display opening for displaying the media. The frame housing also has at least one generic guide on the interior of the frame housing. The at least one interchangeable cartridge insert is adapted to fit in and be supported by the at least one generic guide of the frame housing of the frame structure. The interchangeable cartridge insert includes at least one rail member and a media support panel. The at least one rail member has rails that are adapted to engage with the at least one generic guide of the frame structure. The at least one rail member also has media supports for supporting the media support panel. The media support panel is selected from a plurality of different media display format structures and different thicknesses, such as Styrofoam, cardboard, paperboard, black board, white board, magnetic boards, an electric powered display media, a Styrofoam panel laminated with paper, and the like to display the media. In addition, the media supports of the at least one rail member are coupled to and support the media support panel in the frame structure. The interchangeable cartridge insert can further include at least one clip that is coupled to and supported by the at least one rail member to support additional media along with the media support panel. The support member is a base or a wall mount. The frame housing also includes a door that allows the interchangeable cartridge insert to inserted and removed from the frame housing of the frame structure.

7 Claims, 8 Drawing Sheets

SIGN WITH REPLACEMENT INSERT

RELATED APPLICATIONS

This application claims the benefit of U.S. Provisional application Ser. No. 60/039,602, filed Feb. 28, 1997.

BACKGROUND OF THE INVENTION

1. Field of the Invention

This present invention relates to self standing displays and signs. More specifically, embodiments of the present invention are directed to a standardized display system in which the display can be easily interchanged with numerous other forms of display media.

2. Related Art

Traditionally, frame structures mounted on a stand or mounted on a wall are used for the purpose of holding up poster boards and other signs, and are often used in place of easels during presentations or for presenting an unattended display. Many of these frame structures have the ability to have the display changed by removing old poster board and inserting a replacement poster board in its place through a slot in the frame structure. However, these frame structures are limited to their ability to only hold different posters.

Additionally, chalk boards, dry-erase boards, cork boards, billboards, electronic sign boards, etc. have been supported by frame structures. However, these frame structures do not have the ability to switch from one form of display media to another. Therefore, in classrooms, boardrooms, outside restaurants, hotel lobbies, convention halls and other meeting areas, there are a limited number of ways of presenting information, unless separate, different frame structures are used for each type of separate media. This is a particular problem when a space, such as a hotel ballroom, is used by a variety of different users who prefer different mediums to present information. For example, a seminar would possibly want to use a different display media versus a social event such as a wedding reception held in the same ballroom. Therefore, a hotel will often stock various display media or not have certain media available for their customers.

SUMMARY OF THE DISCLOSURE

It is an object of an embodiment of the present invention to provide an improved media cartridge system for use with various types of display media where different media cartridges can be interchanged within one frame housing, which obviates for practical purposes, the above mentioned limitations.

According to an embodiment of the present invention, a frame structure that displays media includes a support member, a frame housing and at least one interchangeable cartridge insert. The frame housing is supported by the support member and has at least one display opening for displaying the media. The frame housing also has at least one generic guide on the interior of the frame housing. The at least one interchangeable cartridge insert is adapted to fit in and be supported by the at least one generic guide of the frame housing of the frame structure. In preferred embodiments, the support member is a base that is adapted to support the frame housing on a floor surface. In alternative embodiments, the support member is a wall mount that is adapted to support the frame housing on a wall surface. In further embodiments of the present invention, the frame housing includes a door that allows the interchangeable cartridge insert to inserted and removed from the frame housing of the frame structure.

In preferred embodiments of the present invention, the interchangeable cartridge insert includes at least one rail member and a media support panel. The at least one rail member has rails that are adapted to engage with the at least one generic guide of the frame structure. The at least one rail member also has media supports for supporting the media support panel. The media support panel is selected from a plurality of different media display format structures and different thicknesses. In particular embodiments, the media support panel is selected from a group which consists of Styrofoam, cardboard, paperboard, black board, white board, magnetic boards, an electric powered display media, a Styrofoam panel laminated with paper to display the media, and the like. In addition, the media supports of the at least one rail member are coupled to and support the media support panel in the frame structure. In particular embodiments, the interchangeable cartridge insert further includes at least one clip that is coupled to and supported by the at least one rail member to support additional media along with the media support panel. In further embodiments, the at least one clip is a spring actuated clip. In another embodiment of the present invention, the at least one rail member and the media support panel of the interchangeable cartridge insert are adapted to display media on at least two sides of the media support panel.

According to a preferred embodiment of the present invention, a frame housing is useable with an interchangeable media cartridge. The media cartridge is easily removed by opening a door integrated into the outer frame and by sliding the cartridge in and out of the frame housing. The frame housing and cartridge contain complementary protrusions along the top and bottom of the frame housing and cartridge, which are designed to be interconnected to as a rail when the cartridge slides in and out along the frame. Furthermore, the frame housing may be either free-standing or wall-mounted, and the cartridges may be either one or two sided.

According to another preferred embodiment of the present invention, the cartridge is the carrier for a variety of media. The various cartridges can be pre-loaded with display media panels, such as a blackboard, corkboard, dry erase board, a poster board, a magnetic panel or the like, or use more complicated display arrangements, such as a transparent cartridge for use with backlighting transparencies, self illuminating cartridges such as electronic signs or the like.

Other features and advantages of the invention will become apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
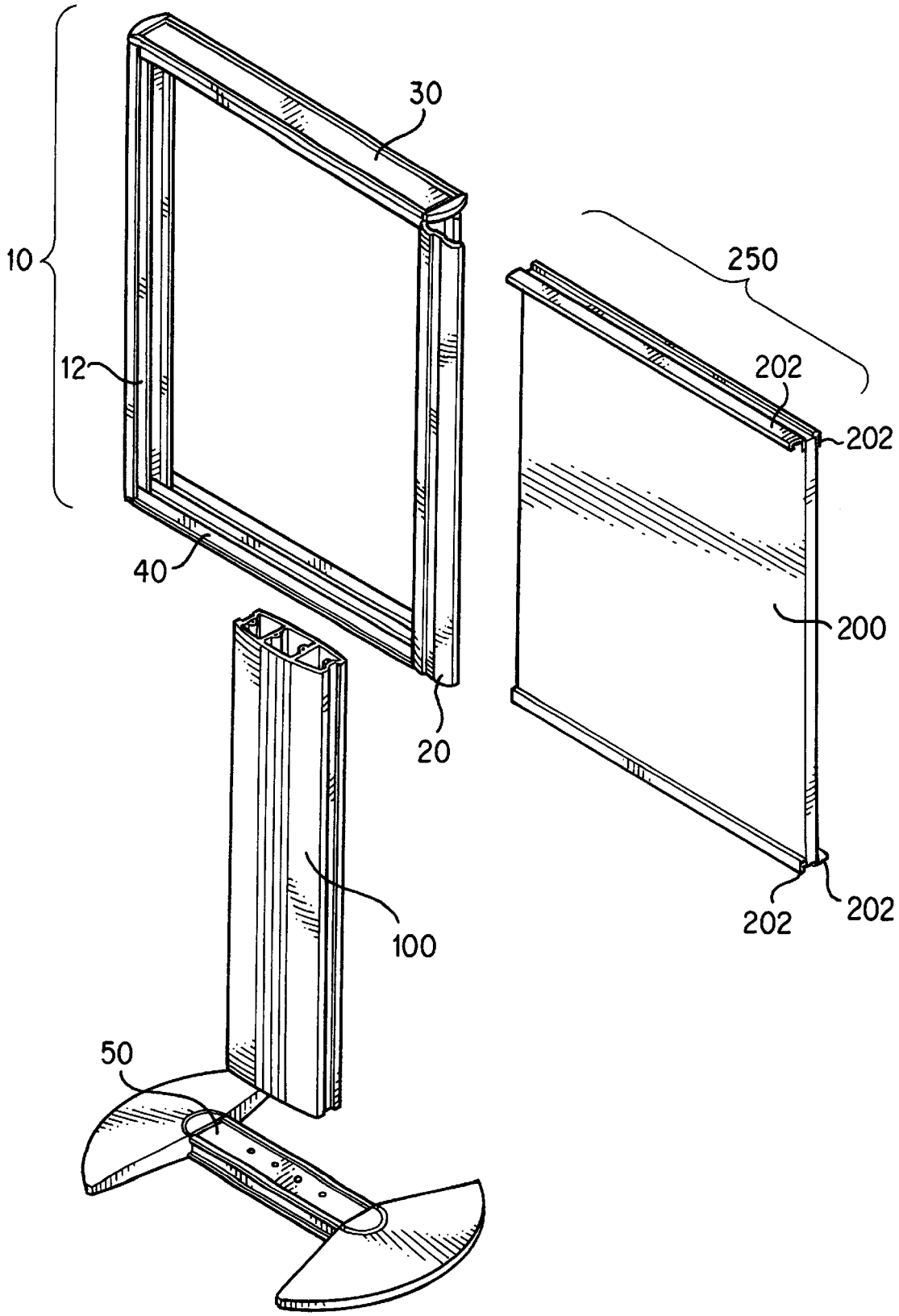
FIG. 1 is an exploded frontal perspective view of the frame housing with a base stand and a interchangeable sign cartridge insert in accordance with one embodiment of the present invention.

A sign board with a replaceable cartridge insert in accordance with a preferred embodiment of the present invention is shown in the drawings for purposes of illustration. However, it should be recognized that further embodiments of the invention may be used in other applications, such as: a frame for photographs, art, paintings, and the like; or as a lecture display using an insert such as a chalk board, a dry erase board and the like; or non-poster signs such as an electronic signs, magnetic boards, felt letter boards, channeled boards, and the like.

In a preferred embodiment of the present invention, a single frame housing 10 is compatible with a variety of interchangeable and replaceable media cartridge inserts 250. By opening a door 20 integrated into one of the sides of the frame housing 10, the standardized media cartridge insert 250 can fit inside the frame housing 10. The cartridge insert 250 can then be replaced by removing the first cartridge insert 250 and sliding in a second cartridge insert 250. By using different forms of display media panels 200 in different cartridge inserts 250, the ability to change the cartridge inserts 250 increases the versatility of the frame housing 10.

FIGS. 1, 2, 4 and 5 show a frame housing 10 in accordance with an embodiment of the present invention. The frame housing 10 is essentially comprised of a top frame member 30, a bottom frame member 40, side frame member 12, and side door member 20 where the frame members 12, 20, 30, and 40 are at right angles to each other and define a generally rectangular opening for the display of the cartridge insert 250. In other alternative embodiments, additional frame members may be used to form frame housings of different sizes and shapes, such as a triangle, hexagon, octagon, or the like. In further alternatives, the side door member 20 may be located on the other side, the top or the bottom, with the placement depending on the environment and use of the frame housing 10. Additionally, either one or both display surfaces of the display media panel 200 of the cartridge insert 250 can be left exposed for viewing by the frame housing 10. In addition, the openings may include a clear insert, such as glass, plastic, film or the like, to protect the display surface from the elements and tampering. Also, as shown in FIG. 1, the frame housing 10 is mounted on a base stand 150. However, in alternative embodiments, the frame housing 10 can either be free-standing or wall-mounted. In further alternative embodiments, the base stand 150 maybe altered in size, height, or shape to accommodate the environment in which the frame housing 10 is used.

Figure 2:
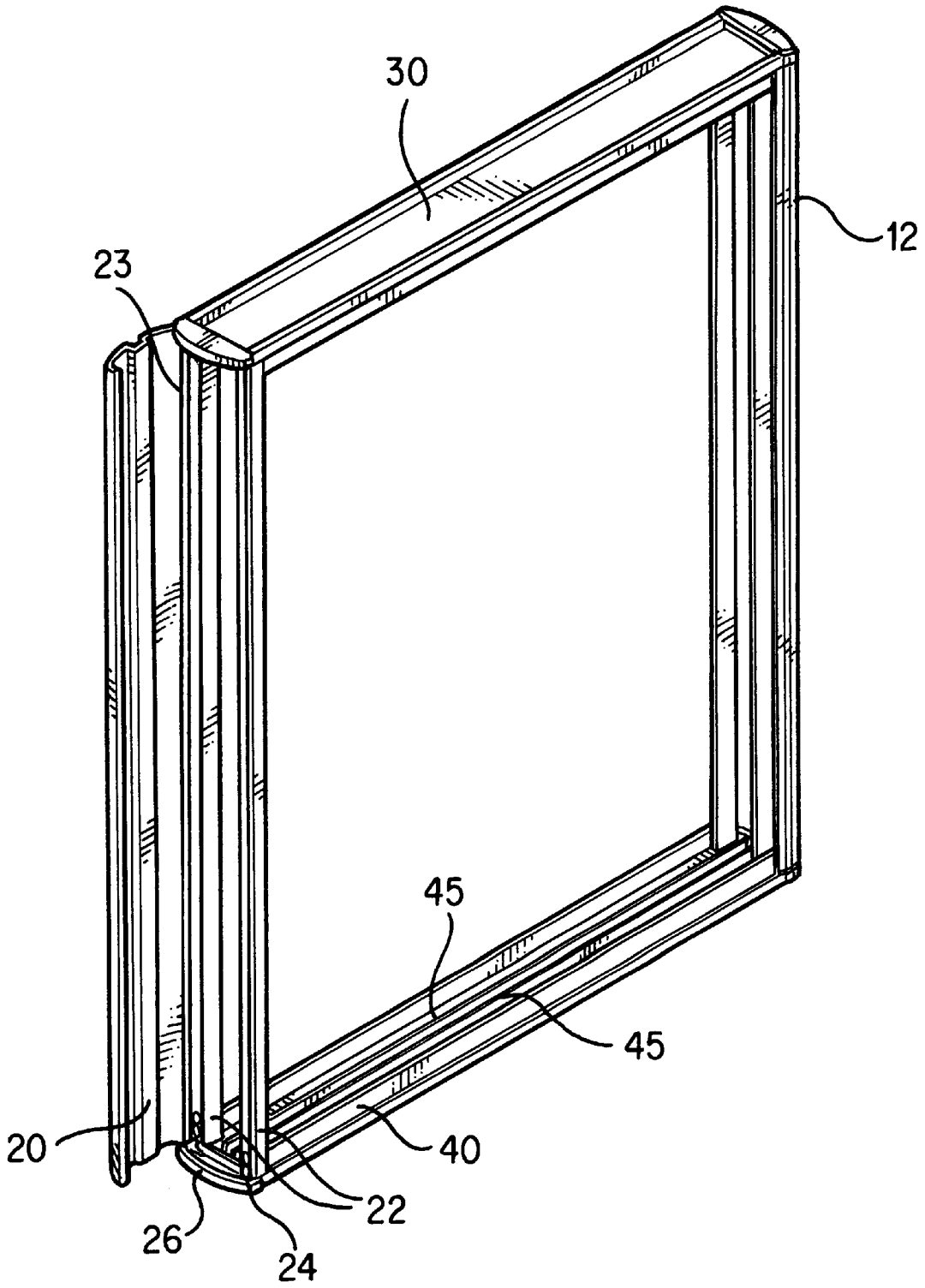
FIG. 2 is a reverse close-up perspective view of the frame housing shown in FIG. 1.

In a preferred embodiment, as shown in FIG. 2, the frame housing 10 includes a side door frame member 20 which provides access to the interior of the frame housing 10 for the cartridge insert 250 to be inserted or removed from the interior of the frame housing 10. The side door member 20 is attached to one of a pair of support beams 22 by a hinge 23, as shown in FIG. 2, to allow the side door member 20 to open and shut. In preferred embodiments of the present invention, the side door member 20 snaps closed. However, in alternative embodiments, the side door 20 may be held closed by a spring, magnet, lock or the like. The support beams 22, rather than the side door member 20, support the frame housing 10, and the support beams 22 are individually attached to the top and bottom frames 30 and 40 by screws 24. In addition, the screws 24 also attach an end cap 26 to the top and bottom of the frame housing 10. The end caps 26 allow the side door member 20 to snap fit over the end caps 26 to keep the side door member 20 shut when the side door member 20 is closed. In alternative embodiments, the frame members 12, 30, 40, and the support beams 22 may be bolted, riveted or welded together. In further alternatives, the frame members may be formed as a single unit by casting or forging.

Figure 9:
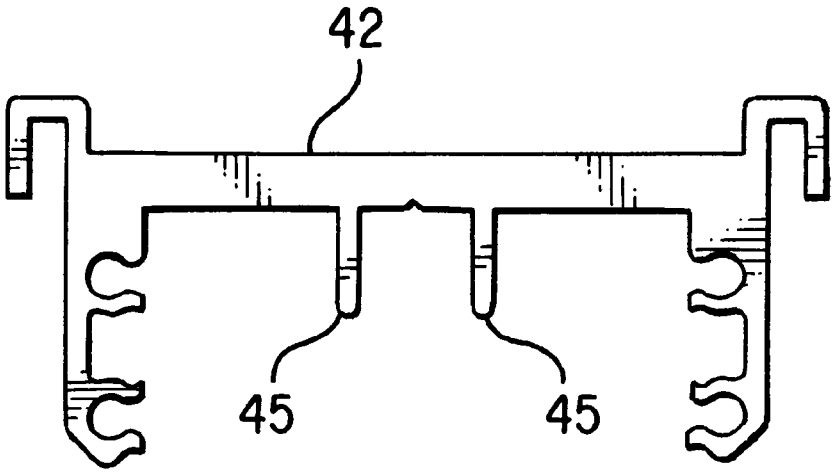
FIG. 9 is a end plan view of the guide tracks structure built inside the frame housing shown in FIG. 1.
Figure 10:
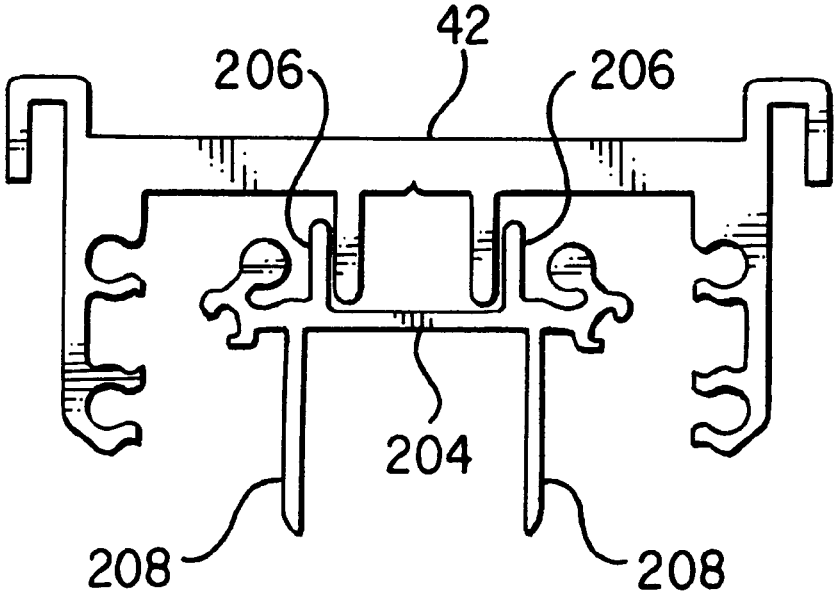
FIG. 10 is a view of the interaction between the guide tracks and the rails once a cartridge insert is inserted into the frame housing shown in FIG. 1.

In a preferred embodiment, as shown in FIG. 9, a guide track member 42 is attached inside the top and bottom members 30 and 40 by screws 24. However, in other embodiments, the guide track member 42 can be screwed, welded, or glued to the top and the bottom frame members 30 and 40. Alternatively, if a top door is used, the guide track members 42 would be mounted to the side members of the frame housing 10. The guide track member 42 has two parallel raised guide tracks 45 which run along the length of the top and bottom members 30 and 40. As shown in FIG. 10, the distance between the raised guide tracks 45 are fixed so that rails 206 of a corresponding rail member 204 affixed to the display media panel 200 can slide over the raised guide tracks 45 and at the same time provide lateral support from the raised guide tracks 45 once the interchangeable cartridge insert 250 is inserted into the frame housing 10. In preferred embodiments, the guide track members 42 and guide tracks 45 are manufactured out of aluminum to minimize wear and tear during the replacement of the cartridge insert 250. However, other materials, such as steel, brass, ceramics, composites, plastics, wood, or the like can be used. In alternative embodiments, the guide track members may be formed as slots, ball bearing surfaces, grooves, different numbers of rails or the like, to accommodate a matching configuration on the cartridge insert 250 to removably secure the cartridge insert 250 in the frame housing 10.

In a preferred embodiment, the frame housing 10 has a thickness, a height and a width, which allows the frame housing 10 to be compatible with a series of corresponding cartridge inserts 250. Once the dimensions of the frame housing 10 are set, correspondingly sized interchangeable cartridge inserts 250 can be manufactured and used with the frame housing 10. For example, in a preferred embodiment, to handle the general size often used to display posters and signs, a frame housing 10 is dimensioned to be about 31 inches high, 24 inches wide, and 4 inches thick to accept interchangeable cartridge inserts 250 with display media panels 200 about 30 inches high, 23 inches wide, and ¾ inches thick to fit inside the frame housing 10. However, a larger or smaller frame housing 10 can be built with its own set of correspondingly larger or smaller interchangeable cartridge inserts 250, to handle different size display media panels 200 and different display applications. Common media sizes used in the frame 10 are 22×28 inches, 24×36 inches, 23×35 inches and the like.

In a preferred embodiment of the frame housing 10, the frame housing is made from a metal alloy such as aluminum, to minimize weight and to assure that the frame structure can support the cartridge insert 250. However, other materials such as steel, brass, ceramics, composites, plastics, wood, or the like can be used.

Figure 3:
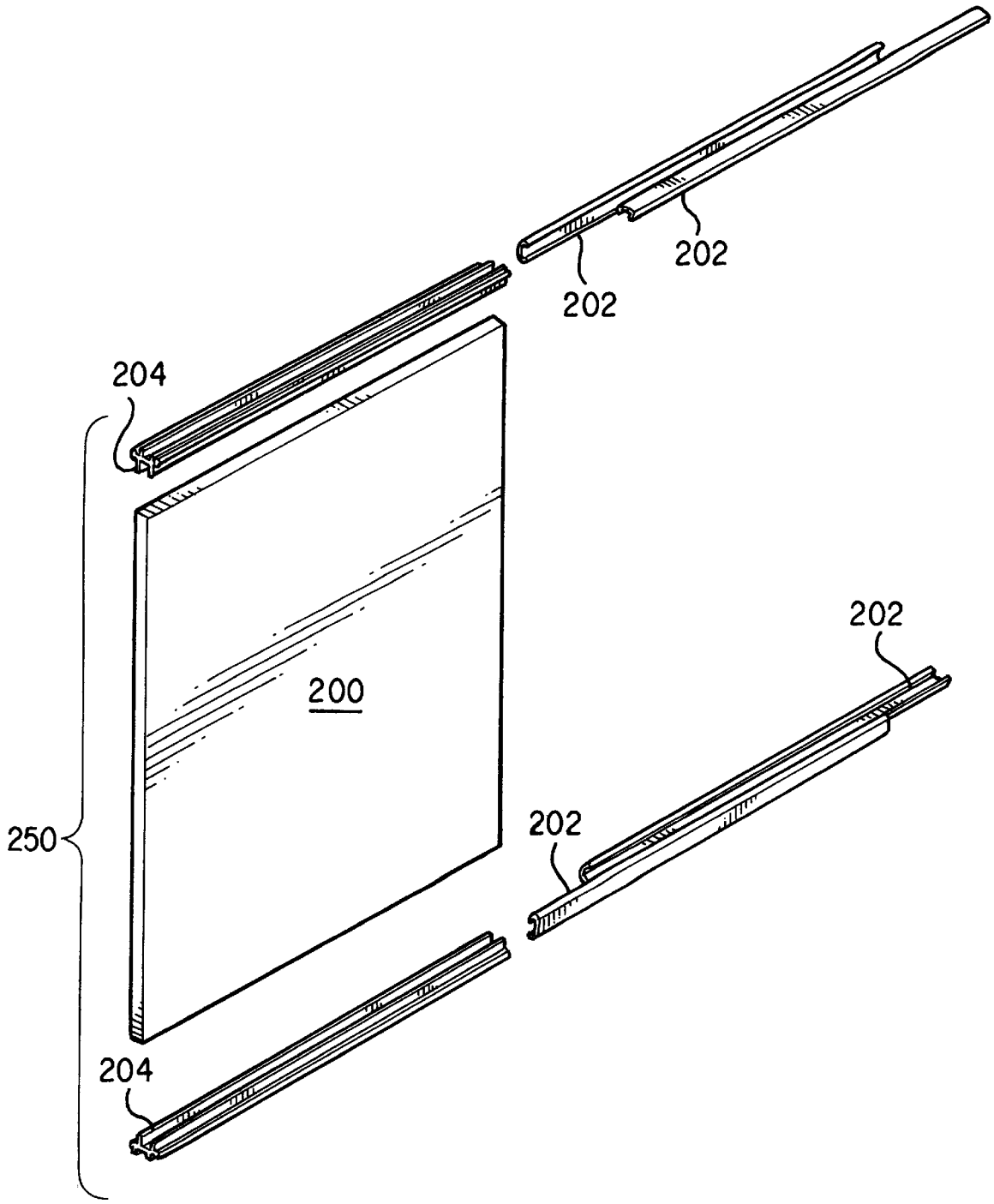
FIG. 3 is an exploded frontal perspective view of the sign cartridge insert shown in FIG. 1.

As shown in FIG. 3, a preferred embodiment of the interchangeable cartridge insert 250 includes the display media panel 200 with a rail member 204 attached to the top of the display media panel 200 and a rail member 204 attached to the bottom of the display media panel 200. Preferably, the display media panel 200 is a Styrofoam board where posters, cardboard, photographs, or other signs can be attached to the surface of the Styrofoam board using pins, adhesives, or the like. However, in other embodiments, a paper board or particle board can be used in place of the Styrofoam board. In further alternatives, posters, cardboard, photographs or other signs may be directly laminated to the display media panel 200.

In a preferred embodiment, the rail member 204 has two display media supports 208 which fit around the display media panel 200, and two rails 206 which fit around the raised guide tracks 45 of the guide track members 42. The rail member 204 is attached to the display media panel 200 by having the display media panel supports 208 frictionally engaged with the display media panel 200. However, in alternative embodiments, the rail member 204 can also be screwed in, glued, or otherwise attached to the display media panel 200. The distance between the display media panel supports 208 is formed based on the thickness of the display media panel 200 to accommodate different forms of display media panel 200 which generally vary in thickness. Thus, a plurality of rail members 204 could be used that have different spacings between the display supports 208, such that a thin cardboard would use a rail member 204 with a narrow spacing between the display media panel supports 208, or a blackboard would use a rail member 204 with a wider spacing between the display media panel supports 208, while maintaining the spacing between the rails 206 so that each of the interchangeable cartridge inserts 250 using different thickness display media panels 200 will fit in the frame housing 10. However, in preferred embodiments, the spacing between the display media supports 208 is fixed to approximately ¾ of an inch and all of the display media panels 200 are sized to this thickness so that a single sized rail member 204 may be used with a large number of different display media panels 200. Thus, the spacing between the rails 206 is standardized for all interchangeable cartridge inserts 250 to fit outside the guide tracks 45 of the guide track members 42 of the standard frame housing 10, and the interchangeable cartridge insert 250 can be used to hold a variety of different types of display media panels 200 with a single generic frame housing 10. In alternative embodiments, the rails 206 are formed with different structures to accommodate the alternative guide structures utilized in the frame 10 as discussed above.

The different interchangeable cartridge inserts 250 compatible with the frame housing 10 include display media panels 200 that are formed from blackboards/chalkboards, bulletin boards, felt letter boards (with or without grooves), white boards/dry erase boards, lighted media, electronic signs including LEDs and LCDs, poster boards both laminated or blank, corkboards, magnetic boards, cardboard signs, and the like. In preferred embodiments, the interchangeable cartridge inserts 250 are two-sided displays with the same type of media on each of the display media panel 200. However, in alternative embodiments, different media may be used on each side of the display media panel 200, such as a blackboard on one side and a dry erase board on the other. Since the frame housing 10 has an opening in the back and the front, the frame housing 10 can be turned around or the interchangeable cartridge insert 250 can be reversed to switch between the two medias or sides of the display media panel 200. Also, the interchangeable cartridge insert 250 can have more than one display media panel 200 on a single side of the display media panel 200. For example, a poster board could be incorporated with an electronic sign (such as a neon sign, a back lit sign, or an LED ticker-tape) along the top of the cartridge insert 250. Therefore, the interchangeable cartridge insert 250, depending on use, can be made from hard plastic, wood, ceramic composite, light weight metal alloy, etc. or a combination thereof.

Figure 6:
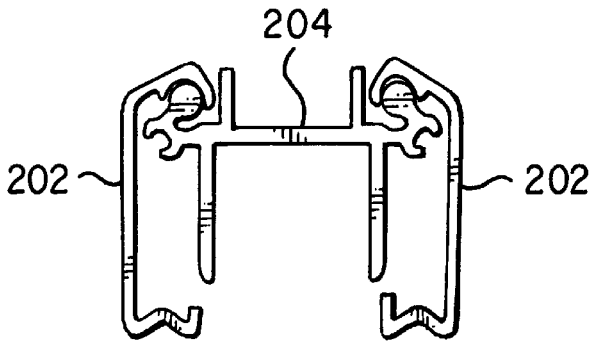
FIG. 6 is a end plan view of a rail and clip assembly of the sign cartridge insert shown in FIG. 1.
Figure 7:
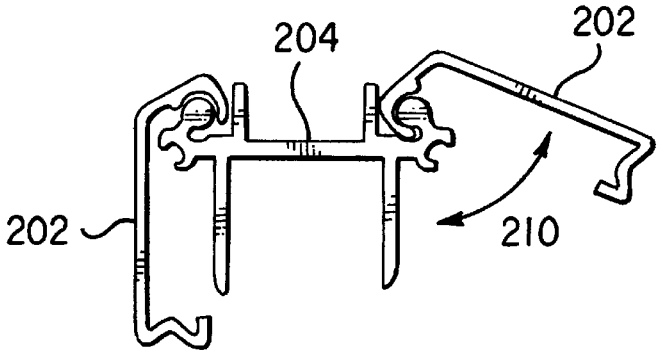
FIG. 7 is another end plan side view of the rail and clip assembly with the clip in the open position as shown in FIG. 1.
Figure 8:
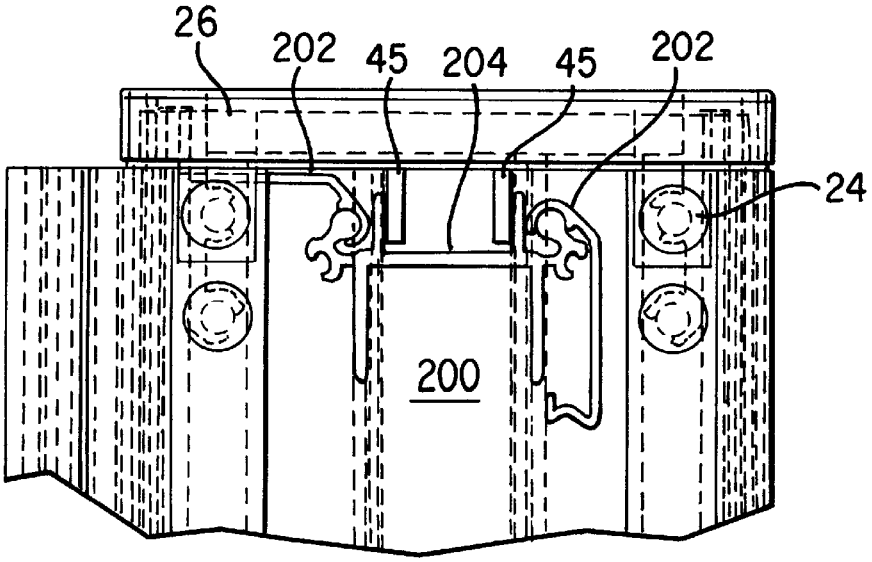
FIG. 8 is end view of the interaction between the guide tracks and the rail once the cartridge is inserted into the frame housing shown in FIG. 1.

Additionally, in preferred embodiments of the present invention, the interchangeable cartridge insert 250 also includes spring loaded clips 202 attached to each side of the rail member 204. The spring clips 202 are attached to the rail member 204 by leaf springs (not shown), so that the spring clips 202 are normally biased in a closed position where the spring clips 202 rest against the display media panel 200, as seen in FIG. 6. However, other ways of attaching the spring clips 202 to the rail member 204 can include torsion springs or other flexible members so that the spring clips 202 will be biased towards the display media panel 200. As shown in FIGS. 1, 3, 7 and 8, the spring clips 202 are movable in an angular direction 210 to allow a poster, photograph, sign, or the like, to be placed underneath the spring clip 202 and then later held in place by the spring force exerted by the spring clip 202 after the spring clip 202 is restored to the closed position. Preferably, the interchangeable cartridge insert 250 includes four spring clips 202 and two rail members 204 attached to a single display media panel 200. However, for certain display media panels 200 that are thicker, such as an electronic display or the like, spring clips 202 on one side of the interchangeable cartridge insert 250 may be omitted to allow the space between the display media panel supports 208 on the rail member 204 to be further enlarged and still allow the interchangeable cartridge insert 250 to fit within the frame housing 10. However, in other embodiments, the interchangeable cartridge insert 250 can omit all the spring clips 202 or keep only one spring clip 202 on the upper rail member 204. Alternative embodiments may utilize similar spring loaded clips as described in U.S. Pat. Nos. 4,145,828 and 4,512,095. In addition, clips that use magnets or springless mechanism may be used, and different lengths of the clips may be used.

Figure 12:
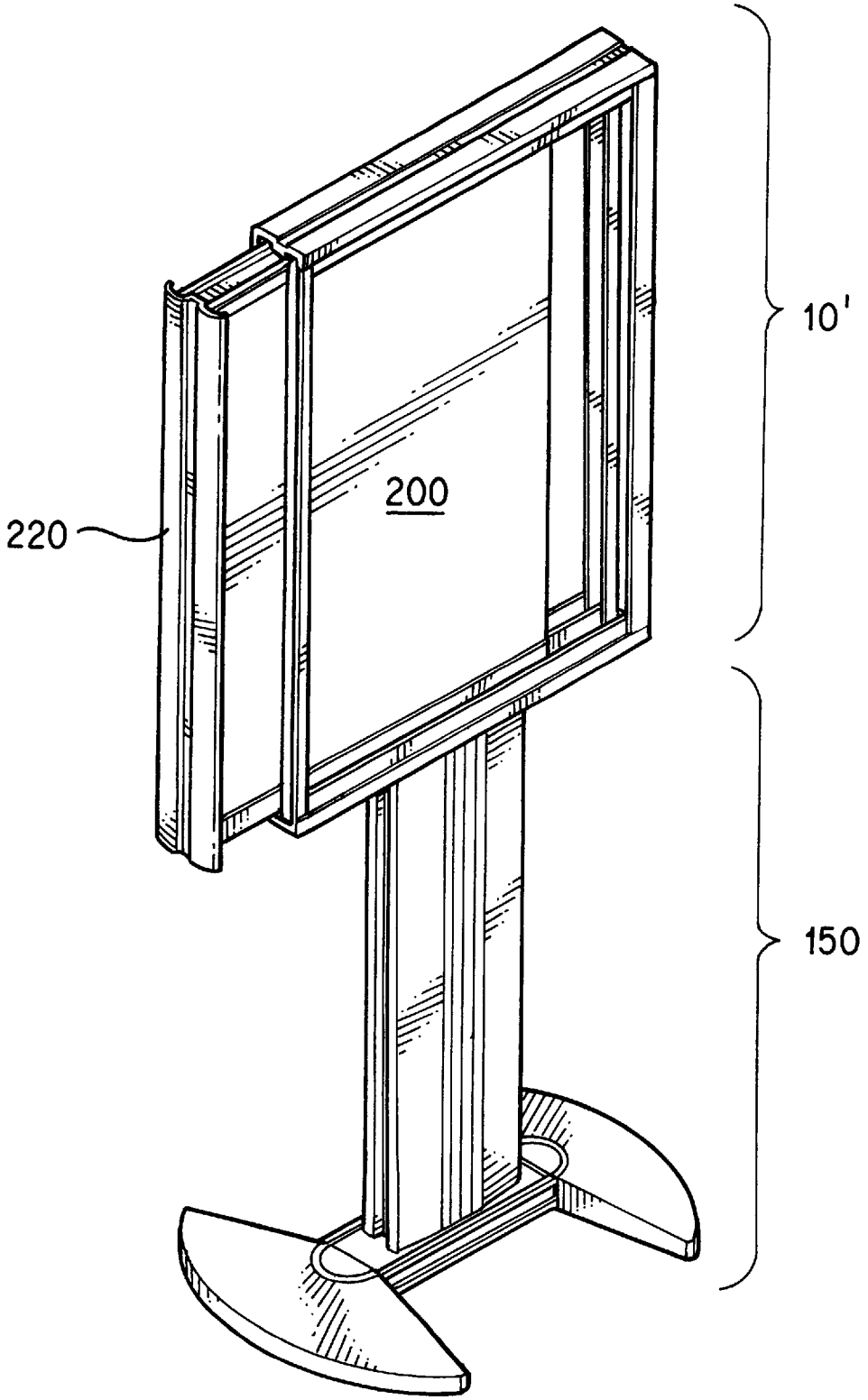
FIG. 12 is perspective view of the frame housing with a base stand and a sign cartridge in accordance with another embodiment of the present invention.

In another embodiment, as shown in FIG. 12, the interchangeable cartridge insert 250 includes a facade 220 attached to a side of the display media panel 200 that matches the side frame 12 of the frame housing 10'. By having the facade 220 attached directly onto the display media panel 200, there is no need for the door 20 to exist on the frame housing 10'. Instead, there only needs to be an opening along one side of the frame housing 10'. When the interchangeable cartridge insert 250 with the facade 220 is inserted into the opening of the frame housing 10', a magnet, snap, or lock can be used to keep the cartridge insert 250 from sliding out of the frame housing 10' and close up the opening along the side of the frame housing 10'.

Figure 4:
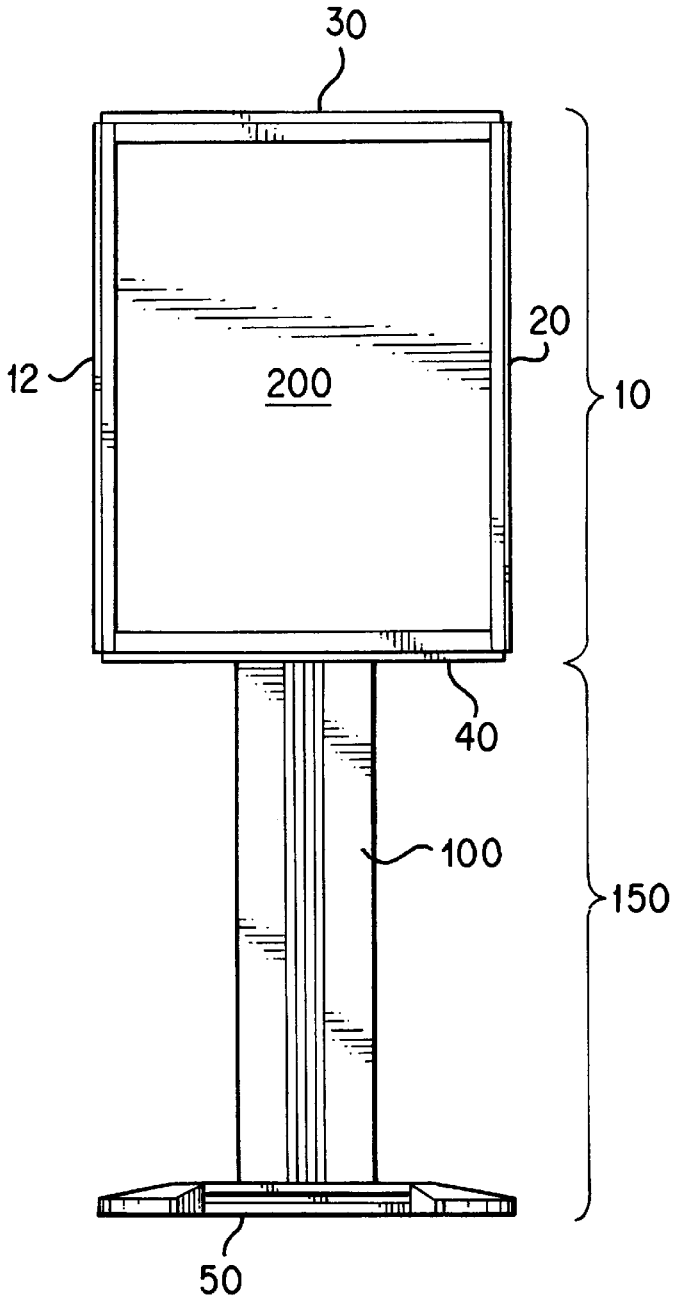
FIG. 4 is a frontal plan view of the frame housing with a base stand shown in FIG. 1.
Figure 5:
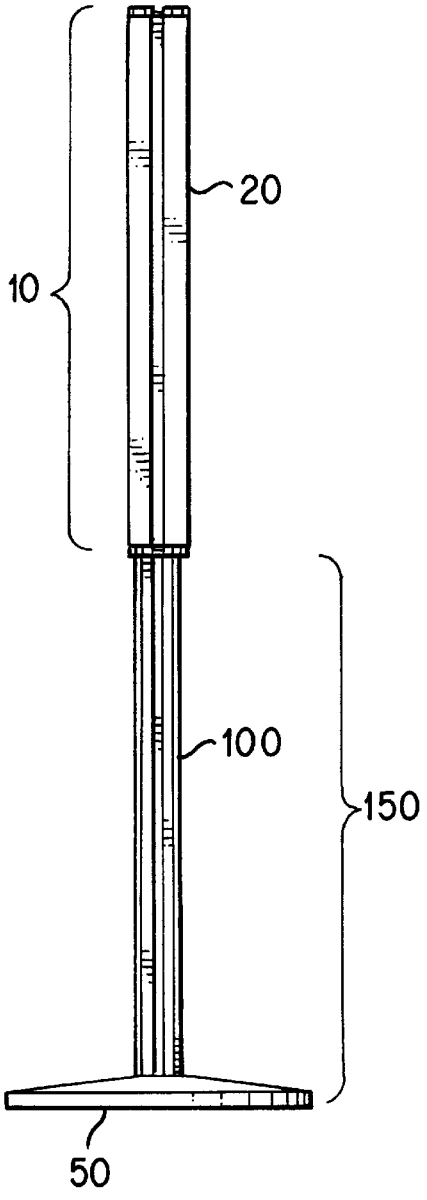
FIG. 5 is a side plan view of the frame housing with a base stand shown in FIG. 1.
Figure 11:
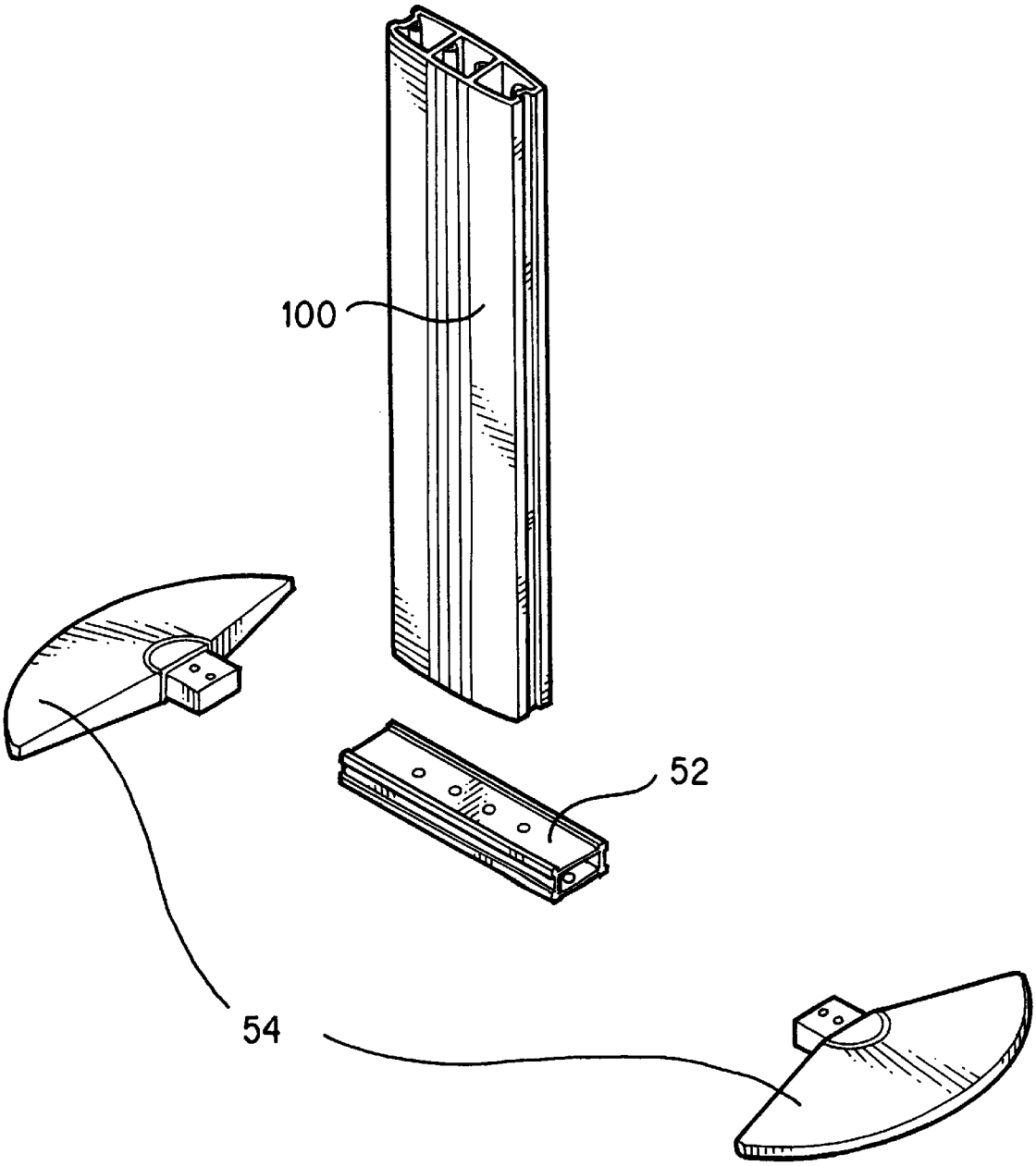
FIG. 11 is a exploded perspective view of the base stand assembly shown in FIG. 1.

In preferred embodiments, the frame housing 10 is mounted on a base stand 150. As shown in FIGS. 1, 4 and 5, the base stand 150 includes a stem 100 and a base 50. As shown in FIG. 11, the base 50 is further formed from a base connector 52 and two feet 54. The base connector 52 is shaped as a hollow rectangular block with an open end at each end. Each foot 54 has a projection which fits snugly into the each open end of the base connector 52, and is screwed on to prevent the foot 54 from falling out of the base connector 52. Furthermore, the base connector 52 has four holes which allows the stem 100 to be screwed into the base connector 52. In addition, the stem 100 has four holes where screws are used to attach the stem 100 to the frame housing 10. The entire base stand 150 is preferably made from a metal alloy. However, other materials such as wood or hard plastic can be used. Additionally, the stand 150 may be altered to be used with different bases, such as a one piece pedestal, a base using legs, or the like. In alternative embodiments, the base may incorporate wheels to facilitate movement and positioning of the sign. In further alternative embodiments, the stand 150 may be omitted and the frame housing 10 may be augmented with brackets or formed to be mounted to a wall or suspended from a ceiling.

In embodiments of the present invention that use display media that require an electric power source, the power source may be contained in the stand 150. For example, batteries may be housed in the base 50 or stem 100, or the stand 150 may be wired to accept and channel external power to the interchangeable cartridge insert 250, such as through AC power adapters or solar cells. In alternative embodiments of the present invention, any required power source may be contained and housed with the interchangeable cartridge insert as a part of the display media panel.

While the description above refers to particular embodiments of the present invention, it should be understood that many modifications may be made without departing from the spirit thereof. For example, top and bottom frames 30 and 40 are shown as having straight edges. However, rounded edges would work just as well. In addition, the guide track members 42 are shown to be on both the top and bottom frames 30 and 40, but an embodiment that uses only a guide track member 42 on the bottom frame 40 is also possible. Furthermore, other methods for sliding the interchangeable cartridge insert 250 in and out of the frame housing 10 can be used, such as wheels or bearings built onto the bottom of the interchangeable cartridge insert 250. Thus, the accompanying claims are intended to cover these and other modifications as would fall within the true scope and spirit of the present invention.

The presently disclosed embodiments are therefore to be considered in all respects as illustrative and not restrictive. The scope of the invention is therefore indicated by the appended claims, rather than the foregoing description, and all changes which come within the meaning and range of equivalency of the claims are therefore intended to be embraced therein.

What is claimed is:

1. A frame structure that displays media, the frame structure comprising:

a support member;

a frame housing supported by the support member and having at least one display opening for displaying the media, wherein the frame housing has at least one generic guide on the interior of the frame housing; and at least one interchangeable cartridge insert adapted to fit in and be supported by the at least one generic guide of the frame housing of the frame structure, the interchangeable cartridge insert including a media support panel, selected from a plurality of different media display format structures and different thicknesses that consists of foam, cardboard, paperboard, black board, white board, magnetic boards, bulletin boards, felt letter boards, particle board, laminated poster boards, cork boards, lighted media, a foam panel laminated with paper and an electric powered display media, adapted to display the media in the frame structure; and at least one rail member adapted to engage with the at least one generic guide of the frame housing, and having media supports, said media supports comprising clamping means to affix in a clamping relationship the at least one rail member directly to the media support panel;

wherein the at least one rail member engages the at least one generic guide of the frame housing to display the media support panel.

2. A frame structure according to claim 1, wherein the interchangeable cartridge insert further includes at least one clip coupled to and supported by the at least one rail member to support additional media along with the media support panel.

3. A frame structure according to claim 2, wherein the at least one clip is a spring actuated clip.

4. A frame structure according to claim 1, wherein the at least one rail member and the media support panel of the interchangeable cartridge insert are adapted to display media on at least two sides of the media support panel.

5. A frame structure according to claim 1, wherein the frame housing includes a door that allows the interchangeable cartridge insert to be inserted and removed from the frame housing of the frame structure.

6. A frame structure according to claim 1, wherein the support member is a base that is adapted to support the frame housing on a floor surface.

7. A frame structure according to claim 1, wherein the support member is a wall mount that is adapted to support the frame housing on a wall surface.

* * * * *